US008332977B2

(12) United States Patent
Bochner et al.

(10) Patent No.: US 8,332,977 B2
(45) Date of Patent: Dec. 18, 2012

(54) BEDSIDE MEDICAL EXAMINATION DEVICE

(75) Inventors: Ronnie Z. Bochner, East Brunswick, NJ (US); Kris D Eager, Richland, MI (US); Michael S. Rozewicz, Kalamazoo, MI (US); Dustin Worm, Plainwell, MI (US); Vaughn Gerber, Portage, MI (US); David Veldkamp, Grand Rapids, MI (US); Timothy Laroy, Kalamazoo, MI (US)

(73) Assignee: Gwenventions, LLC, East Brunswick, NJ (US)

( * ) Notice: Subject to any disclaimer, the term of this patent is extended or adjusted under 35 U.S.C. 154(b) by 525 days.

(21) Appl. No.: 12/716,643

(22) Filed: Mar. 3, 2010

(65) Prior Publication Data

US 2010/0242181 A1 Sep. 30, 2010

Related U.S. Application Data

(60) Provisional application No. 61/156,988, filed on Mar. 3, 2009.

(51) Int. Cl.
*A47B 7/00* (2006.01)
*A47C 17/86* (2006.01)
*A47C 20/02* (2006.01)

(52) U.S. Cl. ..... 5/624; 5/621; 5/648; 5/650; 5/651

(58) Field of Classification Search ..... 5/600, 602, 5/621, 624, 648, 649, 650, 651
See application file for complete search history.

(56) References Cited

U.S. PATENT DOCUMENTS

| | | | |
|---|---|---|---|
| 658,999 | A | 10/1900 | Scannel |
| 724,125 | A | 3/1903 | Prindle |
| 804,089 | A | 11/1905 | Blanc et al. |
| 1,409,330 | A | 3/1922 | Aper |
| 1,568,498 | A | 1/1926 | Caliver |
| 1,943,282 | A | 1/1934 | Bellavia |
| 2,678,461 | A | 5/1954 | Johnson |
| 2,679,445 | A | 5/1954 | Roehm |
| 2,692,812 | A | 10/1954 | Stahl |
| 2,963,332 | A | 12/1960 | Breuning |
| 3,016,275 | A | 1/1962 | Grant |
| 3,085,842 | A | 4/1963 | Johnson |
| 3,334,951 | A | 8/1967 | Douglass, Jr. et al. |
| 3,428,383 | A | 2/1969 | Nobel |

(Continued)

FOREIGN PATENT DOCUMENTS

DE 3015644 A1 10/1981

(Continued)

OTHER PUBLICATIONS

International Search Report and Written Opinion, dated Jun. 22, 2004, issued in International Patent Application No. PCT/US2004/004431.

(Continued)

*Primary Examiner* — J. Liu
(74) *Attorney, Agent, or Firm* — Greenberg Traurig, LLP

(57) ABSTRACT

A medical examination device is provided with a pair of foot support assemblies, a patient support mat, and a pair of legs. Wheel assemblies are attached to the legs facilitate the transportation of the device to and from a bed whereby the support assemblies, patient support mat, and legs are extended and adjusted to support a patient on the bed to facilitate a medical examination. The foot support assemblies, patient support mat, and legs are collapsible so that the device is transported and stored in a small, compact size.

20 Claims, 10 Drawing Sheets

U.S. PATENT DOCUMENTS

| | | | |
|---|---|---|---|
| 3,715,148 | A | 2/1973 | Beals |
| 3,768,971 | A | 10/1973 | Fishpaw |
| 3,966,286 | A | 6/1976 | Groseclose |
| 4,114,965 | A | 9/1978 | Oye et al. |
| D250,584 | S | 12/1978 | Oye |
| 4,139,917 | A | 2/1979 | Fenwick |
| D263,995 | S | 4/1982 | Steele |
| 4,584,731 | A | 4/1986 | Carter |
| D295,156 | S | 4/1988 | Olsson |
| 4,736,998 | A | 4/1988 | Wilson et al. |
| 4,790,610 | A | 12/1988 | Welch et al. |
| D304,075 | S | 10/1989 | Welch |
| 4,913,413 | A | 4/1990 | Raab |
| D311,509 | S | 10/1990 | Failor et al. |
| D332,855 | S | 1/1993 | Royse et al. |
| 5,184,601 | A | 2/1993 | Putman |
| 5,299,338 | A | 4/1994 | Foster |
| 5,399,007 | A | 3/1995 | Marconet |
| 5,405,587 | A | 4/1995 | Fernandez et al. |
| 5,518,310 | A | 5/1996 | Ellman et al. |
| 5,539,941 | A | 7/1996 | Fuller |
| 5,547,270 | A | 8/1996 | Dang |
| 5,564,803 | A | 10/1996 | McDonald et al. |
| 5,662,396 | A | 9/1997 | Reeder et al. |
| 5,702,115 | A | 12/1997 | Pool |
| D409,120 | S | 5/1999 | Aughpin |
| D414,143 | S | 9/1999 | Brotherston |
| D418,779 | S | 1/2000 | Greaves et al. |
| 6,022,088 | A | 2/2000 | Metzler |
| D430,078 | S | 8/2000 | Ellis et al. |
| D454,319 | S | 3/2002 | Ito |
| D456,751 | S | 5/2002 | Williams |
| 6,435,186 | B1 | 8/2002 | Klemm |
| D463,563 | S | 9/2002 | Schoenig et al. |
| 6,619,768 | B1 | 9/2003 | Northrop et al. |
| 6,663,202 | B2 | 12/2003 | Spann |
| D498,184 | S | 11/2004 | Gustafsson |
| D498,712 | S | 11/2004 | Jamison et al. |
| D504,848 | S | 5/2005 | Freeborn et al. |
| D512,149 | S | 11/2005 | Bochner et al. |
| D519,064 | S | 4/2006 | Schrand et al. |
| 7,024,711 | B1 | 4/2006 | Stasney et al. |
| D522,143 | S | 5/2006 | Cartwright |
| D540,949 | S | 4/2007 | Sundstrom |
| D550,361 | S | 9/2007 | Cartwright |
| D554,261 | S | 10/2007 | Meoli et al. |
| 7,275,796 | B2 | 10/2007 | Bochner et al. |
| 7,311,657 | B2 | 12/2007 | Boone et al. |
| D602,404 | S | 10/2009 | Cusack et al. |
| 7,694,684 | B2 | 4/2010 | Bochner et al. |
| D615,207 | S | 5/2010 | Bochner et al. |
| 2004/0160147 | A1 | 8/2004 | Bochner |
| 2007/0035217 | A1 | 2/2007 | Bochner et al. |
| 2009/0179533 | A1 | 7/2009 | Bochner |

FOREIGN PATENT DOCUMENTS

| | | |
|---|---|---|
| GB | 403503 | 12/1933 |
| WO | WO 2004/071366 A1 | 8/2004 |

OTHER PUBLICATIONS

International Preliminary Report on Patentability, dated Jan. 31, 2004, issued in International Patent Application No. PCT/US2004/004431.

Non-final Office Action of U.S. Appl. No. 10/545,033, mailed Apr. 10, 2009.

Non-final Office Action of U.S. Appl. No. 12/409,747, mailed Jan. 27, 2010.

BEDSIDE MEDICAL EXAMINATION DEVICE

CROSS-REFERENCE TO RELATED APPLICATION

This application is a Section 111(a) application relating to commonly owned, U.S. Provisional Application Ser. No. 61/156,988 entitled "BESIDE MEDICAL EXAMINATION CART," filed Mar. 3, 2009, which is incorporated by reference herein in its entirety.

FIELD OF THE INVENTION

The present invention relates to medical examination devices and, more particularly, to a collapsible bedside medical examination device.

BACKGROUND OF THE INVENTION

Medical practitioners regularly utilize stationary medical examination tables especially adapted to support a patient to facilitate a medical examination (e.g., a gynecological examination). Moveable bedside medical examination tables have been developed for facilitating medical examinations of patients that may be bed-bound or are unable to position themselves on stationary medical examination tables. Such moveable tables are often expensive and large in size, and an inexpensive device to facilitate a medical examination for a bed-bound patient that is collapsible and compact in size has yet to be provided.

SUMMARY OF THE INVENTION

The present invention overcomes the above-identified problems and disadvantages by providing an inexpensive device for conducting medical examinations for bed-bound patients. In an embodiment, the device includes a frame structure having a transverse member, first and second laterally-spaced, parallel side members attached to and extending from the transverse member, and first and second legs telescopically attached to the first and second side members, respectively. In an embodiment, each of the legs are adjustably and slidably movable between a collapsed (i.e., stored) position and an extended position. In an embodiment, locking collars are provided to lock the legs and restrain them from movement relative to the side members. In an embodiment, when the legs are in their desired extended positions, the device is placed against a patient's bed and, more particularly, the transverse member abuts the foot of the bed. In an embodiment, the legs may be adjusted to account for the height of the bed.

In an embodiment, a support mat is pivotally attached to the frame structure and is pivotal between an extended position, in which said support mat extends in a substantially horizontal direction, and a folded (i.e., stored) position. In an embodiment, the support mat includes a plurality of panels that are pivotally attached to one another. In an embodiment, the support mat is sized and shaped so as to be placed on a bed while in its extended position, and supports a patient thereon during the performance of a medical examination. In an embodiment, first and second foot supports are pivotally attached to the transverse member, and are sized and shaped so as to support one foot of a patient during the performance of the medical examination. In an embodiment, the foot support assemblies, the support mat, and the legs are collapsible so that the device may be transported and stored in a small, compact size. In an embodiment, wheel assemblies are attached to each of the legs to facilitate the support and transportation of the device on a floor surface.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE EXEMPLARY EMBODIMENT

Figure 1:
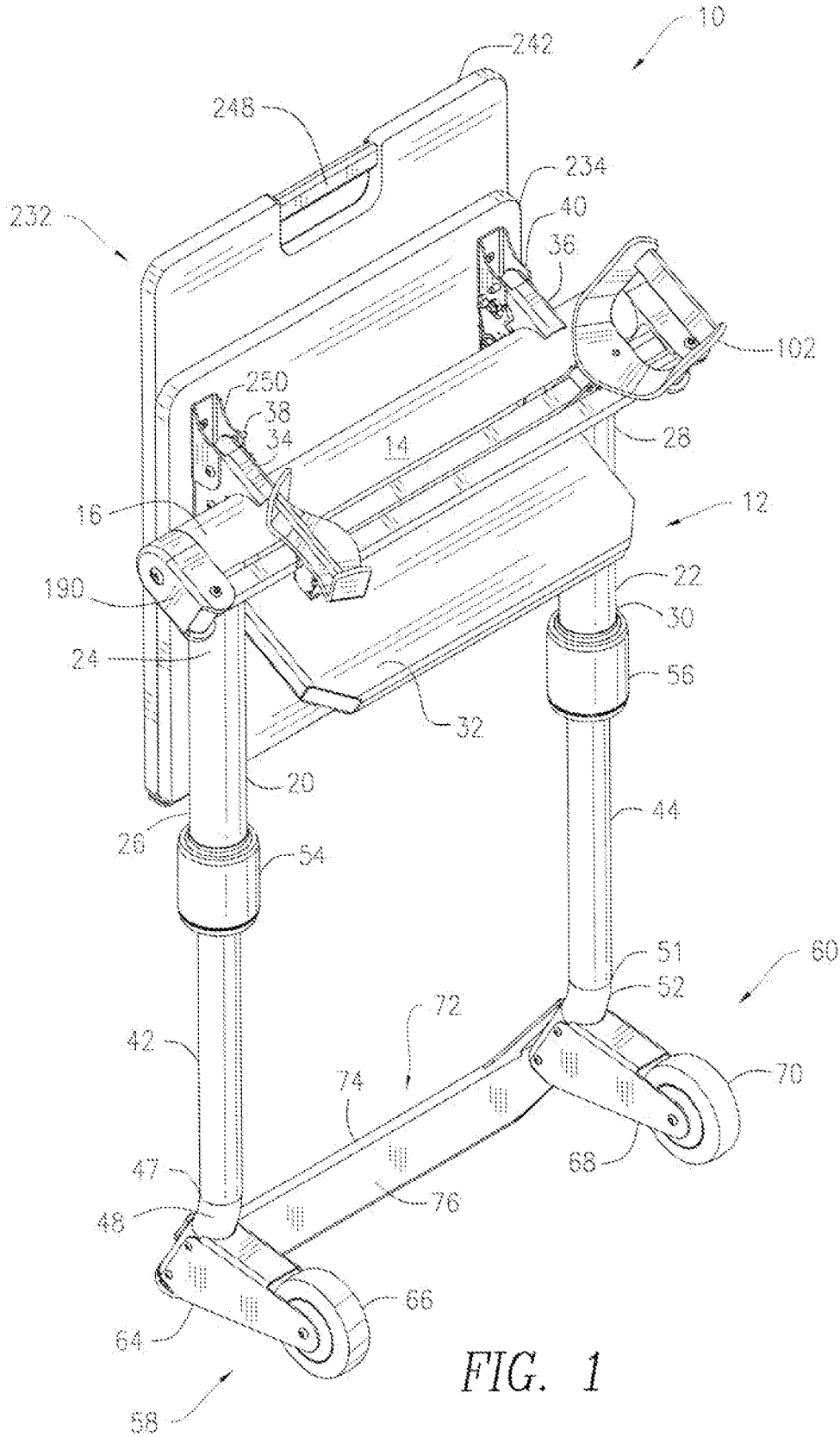
FIG. 1 is a perspective view of a medical examination device constructed in accordance with an embodiment of the present invention, the device being shown with its legs in their extended positions and with its foot support assemblies and its patient support pads in their collapsed positions.

FIGS. 1-6 illustrate a medical examination device 10 constructed in accordance with the present invention. More particularly, the device 10 includes a U-shaped frame structure 12 having a cylindrical transverse member 14 (see FIG. 4) with a pair of opposing ends 16, 18. A pair of laterally spaced tubular side members 20, 22 extends downwardly from the ends 16, 18, respectively. The side member 20 has upper and lower ends 24, 26, respectively, while side member 22 has upper and lower ends 28, 30, respectively. The upper ends 24, 28 of side members 20, 22 are fixedly attached to the transverse member 14, proximate ends 16,18 respectively, such that the longitudinal axes of the side members 20, 22 are substantially parallel with each other and perpendicular to the longitudinal axis of the transverse member 14. The frame structure 12 also includes a shelf 32 fixedly attached to the frame structure 12 for purposes to be discussed hereinafter.

Brackets 34, 36 facilitate the attachment of the shelf 32 to the transverse member 14. More particularly, the bracket 34 is fixedly attached to the transverse member 14 proximate the side member 20, while the bracket 36 is fixedly attached to the transverse member 14 proximate the side member 22. The brackets 34, 36 also provide hinge points 38, 40 for purposes to be discussed hereinafter.

The side members 20, 22 and the brackets 34, 36 are welded to the transverse member 14, and the shelf 32 is welded to the brackets 34, 36. While the frame structure 12 is rigidly constructed of tubular and sheet metal, other suitable materials (e.g., fiberglass or plastic) and fastening arrangements (e.g., resin or glue) may be utilized.

Figure 2:
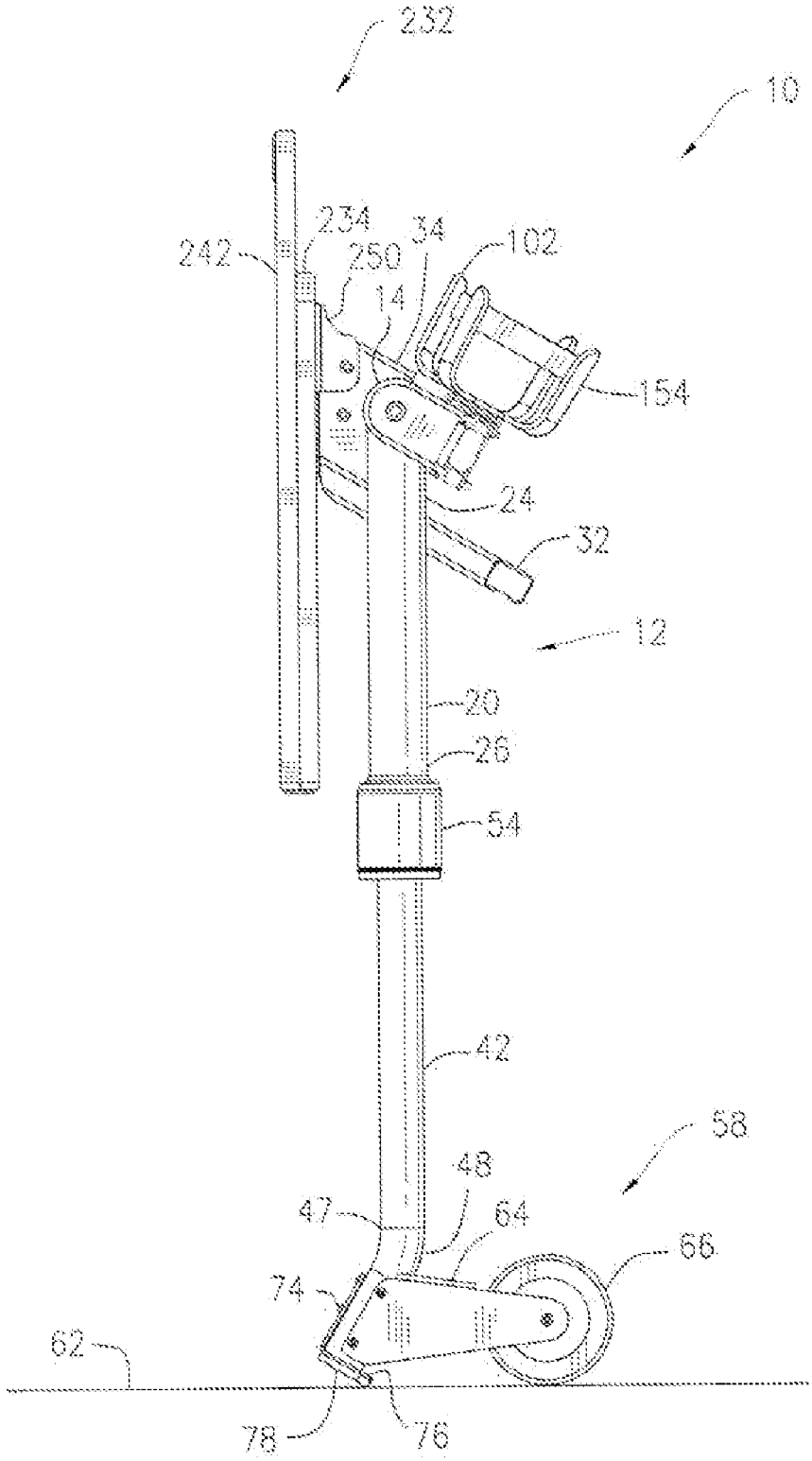
FIG. 2 is a side elevational view of the medical examination device shown in FIG. 1.
Figure 3:
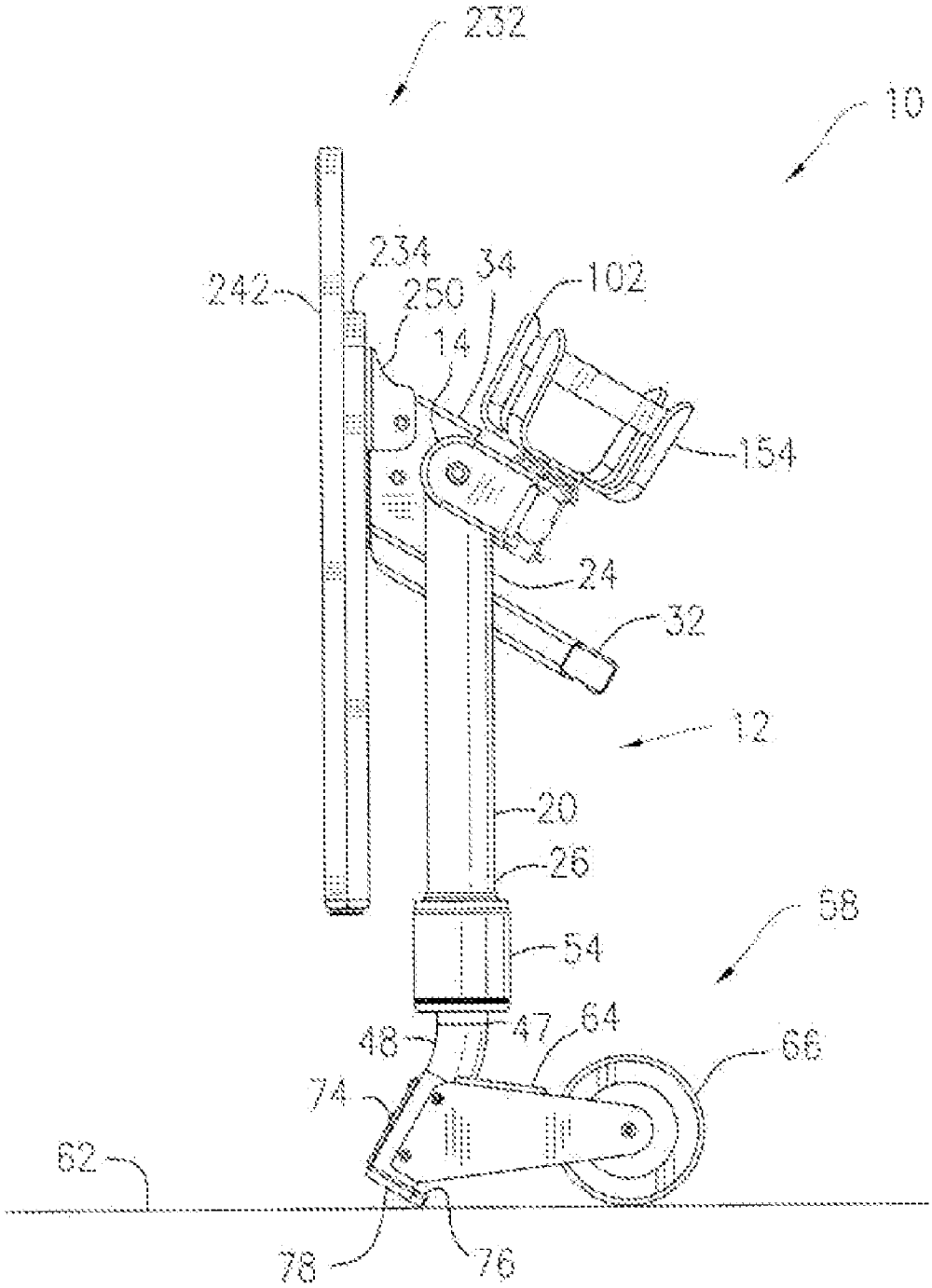
FIG. 3 is a side elevational view of the medical examination device shown in FIG. 2, the device being shown with its legs in their collapsed positions.

Continuing to refer to FIGS. 1-6, legs 42, 44 are telescopically attached to the frame structure 12. More particularly, the leg 42 has an upper end 46 (see FIG. 6) and a lower end 47 with an extension 48 fitted at an angle thereto. Similarly, the leg 44 has an upper end 50 (see FIG. 6) and a lower end 51 with an angular extension 52 fitted thereto. The legs 42, 44 are sized and shaped to slidingly (i.e., telescopically) move within the interior of the tubular side members 20, 22 respectively (e.g., extended, as shown in FIGS. 1-2, or collapsed, as shown in FIG. 3). The legs 42, 44 and side members 20, 22 are fitted with conventional locking type collars 54, 56, respectively. The collars 54, 56 are adapted to guide, limit and lock the movement of the legs 42, 44 relative to the side members 20, 22 respectively. Commercially available products such as Grip Fast™ Shaft Collar/Fasteners (e.g., provided by Specialized Marketing International, Inc.) may be utilized, although other suitable locking mechanisms may be employed (e.g., set screws or pins).

Still referring to FIGS. 1-6, wheel assemblies 58, 60 are attached to the extensions 48, 52 of the legs 42, 44, respectively, for supporting and transporting the device 10 on a surface, such as a floor 62. More particularly, the wheel assembly 58 has a bracket 64 that pivotally supports a wheel 66, while the wheel assembly 60 has a bracket 68 that pivotally supports a wheel 70. The bracket 64 is oriented on the extension 48 of leg 42 such that the axel of the wheel 66 is parallel to the longitudinal axis of the transverse member 14. Similarly, the bracket 68 is oriented on the extension 52 of leg 44 such that the axel of the wheel 70 is parallel to the longitudinal axis of the transverse member 14. The brackets 64, 68 are fabricated of metal or other suitable material and are rigidly fastened to the extensions 48, 52, respectively, by screws or other suitable fasteners.

A rigid L-shaped cross member 72 is transversely mounted between the extensions 48, 52 of the legs 42, 44, respectively, and is oriented substantially parallel with the longitudinal axis of the transverse member 14. More particularly, the cross member 72 has a vertically gusset plate 74 perpendicularly affixed to a flat horizontal plate 76. The gusset plate 74 is fastened to the extensions 48, 52 at a location distal to the wheels 66, 70, respectively, in order to constrain the position of the extensions 48, 52 in substantially fixed relationship to each other (i.e., the legs 42, 44 remain substantially parallel with each other and move substantially equal distances in relation to the side members 20, 22, respectively). The cross member 72 is fabricated from formed or stamped metal plate or other suitable material, and is attached to the extensions 48, 52 by screws or other suitable fasteners.

Figure 5:
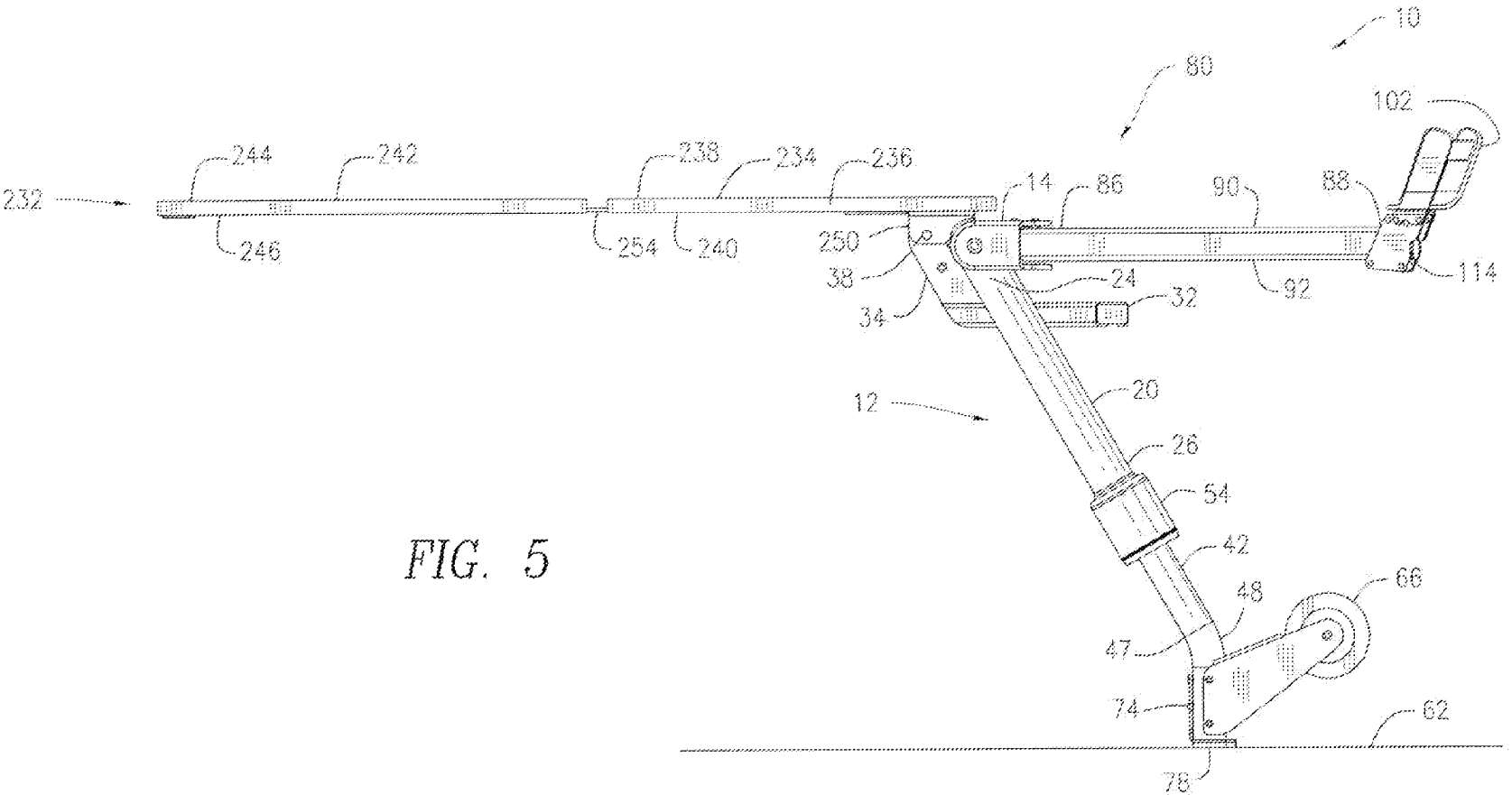
FIG. 5 is a side elevational view of the medical examination device shown in FIG. 4.

A flat pad 78, which has a uniform thickness, is made of elastomeric material (e.g., rubber) and fastened (e.g., glued) to the bottom of the horizontal plate 76 of the cross member 72 such that when the weight of the device 10 is transferred from the wheels 66, 70 to the pad 78, the pad 78 will inhibit the device 10 from moving on the floor 62. With reference to FIG. 5, when the pad 78 is positioned flush (i.e., parallel) with the floor 62, the device 10 is configured such that the shelf 32 is oriented parallel to the floor 62 for purposes to be described hereinafter.

Figure 6:
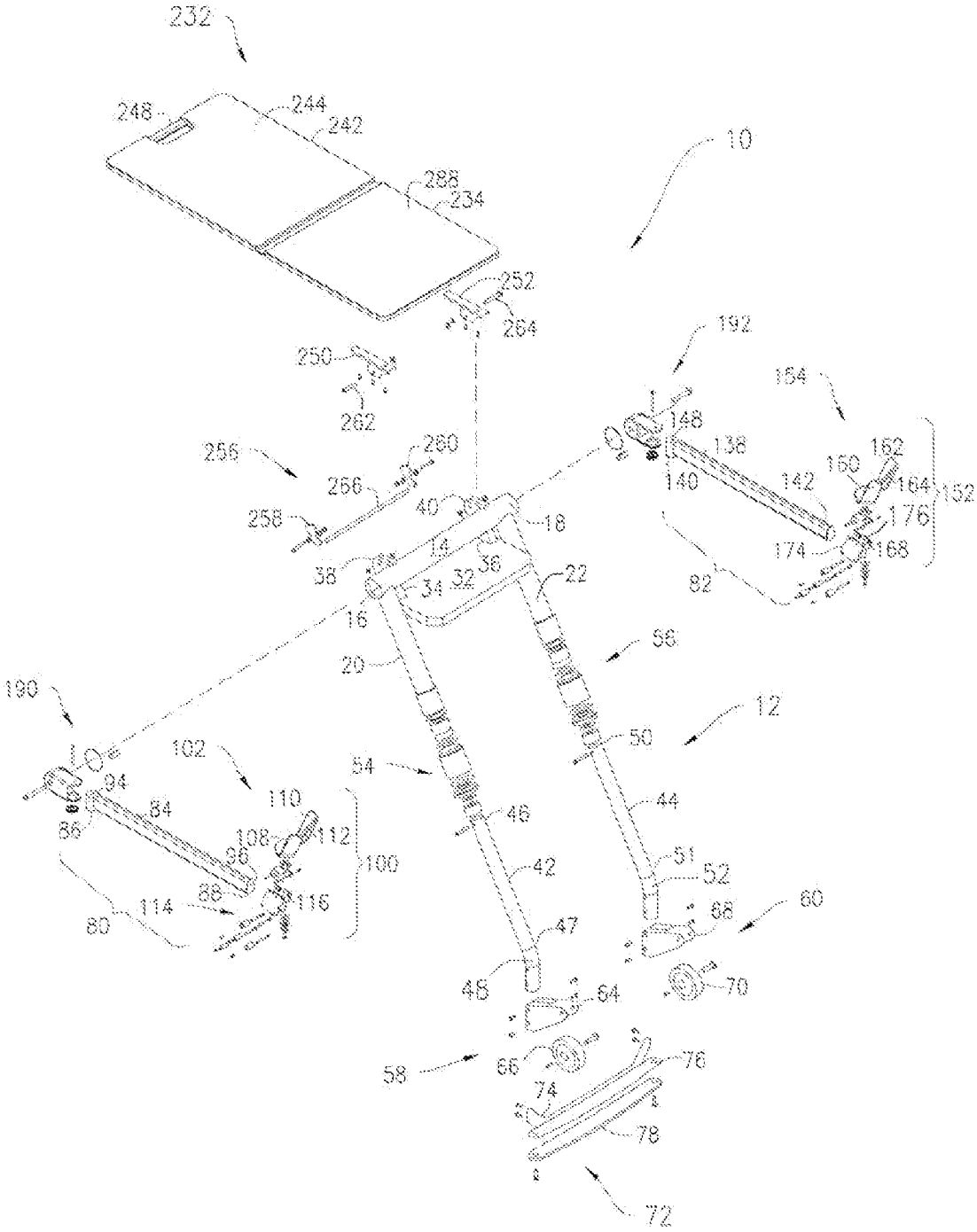
FIG. 6 is an exploded perspective view of the medical examination device shown in FIG. 4.
Figure 7:
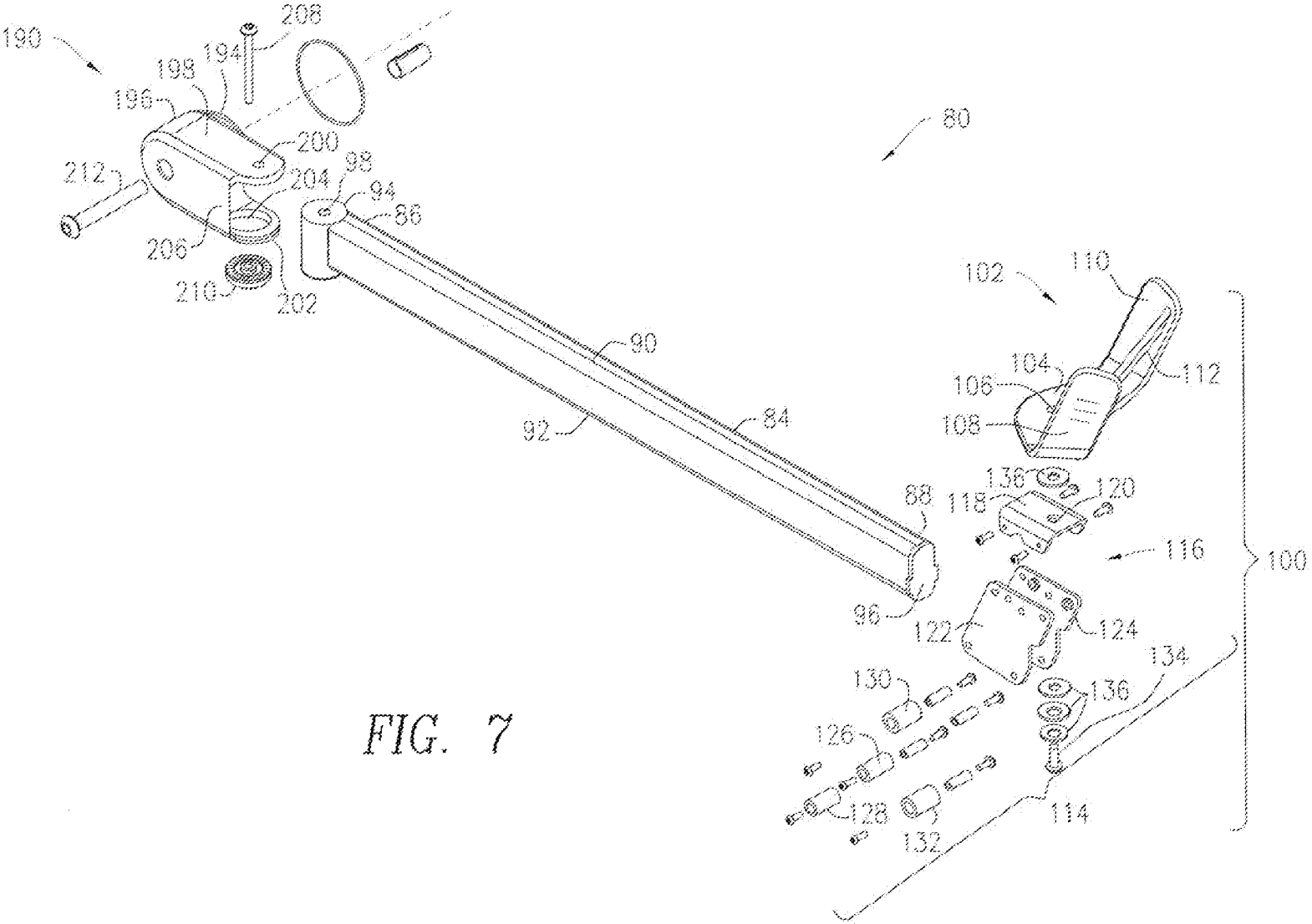
FIG. 7 is an exploded perspective view of one of the foot support assemblies shown in FIGS. 4-6.

Referring now to FIGS. 6-7, foot support assemblies 80, 82 are pivotally attached to the ends 16, 18, respectively, of the transverse member 14. More particularly and with specific reference to FIG. 7, the foot support assembly 80 includes an elongated rigid tubular rail 84 which has a pair of opposing ends 86, 88 and a pair of opposing upper and lower surfaces 90, 92. The rail 84 has a cylindrical base 94 positioned at the end 86 and a vertical stop plate 96 positioned at the end 88. A circular channel 98 is vertically oriented along the longitudinal axis of the base 94 for purposes to be discussed hereinbelow.

Referring to FIG. 7, a foot engaging unit 100 is slidably fastened to the rail 84 of the foot support assembly 80. The foot engaging unit 100 includes a stirrup 102, which is constructed and operates in a manner similar to conventional stirrups that are currently in use for supporting the feet of patients during medical examinations. More particularly, the stirrup 102 has a horizontal support plate 104 with an orifice 106, and a pair of laterally spaced side plates 108, 110 that extend vertically from the support plate 104. A slanted plate 112 extends transversely between the side plates 108, 110.

Continuing to refer to FIG. 7, a rail follower assembly 114 is pivotally attached to the stirrup 102. More particularly, the rail follower assembly 114 includes an inverted U-shaped bracket 116 that has a horizontal plate 118 with an orifice 120 and a pair of laterally spaced vertical plates 122, 124 extending downwardly therefrom. The bracket 116 is fitted with upper and lower elastomeric friction members 126, 128 that are rigidly supported horizontally between the vertical plates 122, 124 (further details concerning the construction and function of these and other elements of the rail follower assembly 114 will become apparent from the following detailed description of FIGS. 8 and 9, which figures relate to a companion rail follower assembly). The bracket 116 also has upper and lower rolling members 130, 132 that are pivotally supported horizontally between the vertical plates 122, 124. The rolling members 130, 132 may be fabricated from plastic or other suitable material, such as a composite. A pin 134 extends through a plurality of washers 136, the orifice 120 of the bracket horizontal plate 118, the orifice 106 of the stirrup horizontal plate 104, and is fixedly attached to the stirrup 102. In this manner, the stirrup 102 is pivotally fasten to the bracket 116 and is therefore free to rotate about the rail follower assembly 114.

The rail follower assembly 114 is sized and shaped such that the upper and lower friction members 126, 128 bear on the upper and lower surfaces 90, 92, respectively, of the rail 84, when the foot engaging unit 100 is resting on the rail 84. The friction members 126, 128 will restrain the foot engaging unit 100 from moving away from the base 94 of the rail 84 when a force (not shown) is applied to the stirrup 102 in a direction away from the base 94 (i.e., along the longitudinal axis of the rail 84). The foot engaging unit 100 may be positioned anywhere along the rail 84 by raising and/or positioning the rail follower assembly 114 such that the friction members 126, 128 do not bear on the upper and lower surfaces 90, 92, respectively, of the rail 84, and the upper and lower roller members 130, 132 bear on the upper and lower surfaces 90, 92, respectively, of the rail 84.

The foot support assembly 82 is basically identical, in construction and operation, to the foot support assembly 80. In such circumstances, the construction and operation of the foot support assembly 82 will be discussed briefly hereinafter without describing the details thereof.

Figure 8:
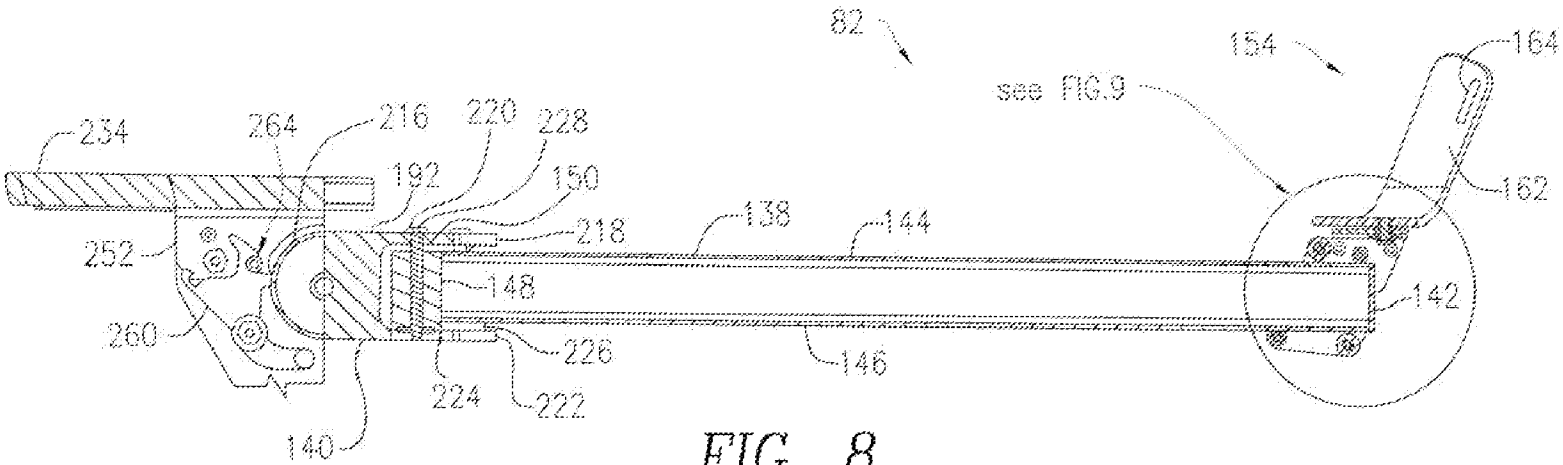
FIG. 8 is a cross-sectional view, taken along section line 8-8 of FIG. 4 and looking in the direction of the arrows, of one of the foot support assemblies shown in FIGS. 4 and 6.
Figure 9:
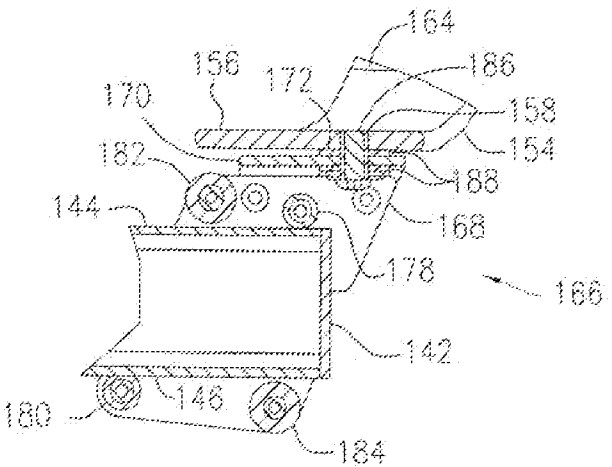
FIG. 9 is a cross-sectional view depicting the circled area of FIG. 8, the elements within the circled area being shown in an enlarged scale for purposes of clarity.

Referring to FIGS. 6 and 8-9, like the foot support assembly 80, the foot support assembly 82 includes an elongated rigid tubular rail 138 having a pair of opposing ends 140, 142 and a pair of opposing upper and lower surfaces 144, 146. The rail 138 has a cylindrical base 148 positioned at the end 140. A circular channel 150 is vertically oriented along the longitudinal axis of the base 148.

A foot engaging unit 152 is slidably fastened to the rail 138 of the foot support assembly 82. The foot engaging unit 152 includes a stirrup 154 which has a horizontal support plate 156 with an orifice 158 and a pair of laterally spaced side plates 160, 162 that extend vertically from the support plate 156. A slanted plate 164 extends transversely between the side plates 160, 162.

Continuing to refer to FIGS. 6 and 8-9, a rail follower assembly 166 is pivotally attached to the stirrup 154. More particularly, the rail follower assembly 166 includes an inverted U-shaped bracket 168 that has a horizontal plate 170 with an orifice 172 and a pair of laterally spaced vertical plates 174, 176 extending downwardly therefrom. The bracket 168 is fitted with upper and lower elastomeric friction members 178, 180 that are rigidly supported horizontally between the vertical plates 174, 176. The bracket 168 also has upper and lower rolling members 182, 184 that are pivotally supported horizontally between the vertical plates 174, 176. A pin 186 extends through a plurality of washers 188, the orifice 172 of the bracket horizontal plate 170, the orifice 158 of the stirrup horizontal plate 156, and is fixedly attached to the stirrup 154.

The rail follower assembly 166 is sized and shaped such that the upper and lower friction members 178, 180 bear on the upper and lower surfaces 144, 146 of the rail 138, respectively, when the foot engaging unit 152 is resting on the rail 138. The friction members 178, 180 will restrain the foot engaging unit 100 from moving away from the base 148 of the rail 138 when a force (not shown) is applied to the stirrup 154 in a direction away from the base 148 (i.e., along the longitudinal axis of the rail 138). The foot engaging unit 152 may be positioned anywhere along the rail 138 by raising and/or positioning the foot engaging unit 152 such that the upper and lower friction members 178, 180 do not bear on the upper and lower surfaces 144, 146, respectively, of the rail 138, and the upper and lower roller members 182, 184 bear on the upper and lower surfaces 144, 146, respectively, of the rail 138.

With reference to FIGS. 6-8, a pair of unions 190, 192 pivotally connect the foot support assemblies 80, 82 to the ends 16, 18, respectively, of the transverse member 14. More particularly and with specific reference to FIG. 7, the union 190 has a disc-shaped end cap 194 with a collar 196 fastened thereto. The collar 196 has a horizontal upper hinge plate 198 with a circular orifice 200 positioned therein, a horizontal lower hinge plate 202 with a circular orifice 204 positioned therein, and a vertical stop plate 206 extending vertically between the upper and lower plates 198, 202. The diameter of the vertical channel 98 of the base 94 of the rail 84 is substantially the same as the diameter of the orifice 200 of the upper hinge plate 198 of the union 190. The base 94 is pivotally positioned in the collar 196, between the upper and lower plates 198, 202. A pin 208 extends through the orifice 200 of the upper hinge plate 198 and the channel 98 of the base 94, and is fastened to a circular disc 210 that is fixedly attached to the lower plate 202.

A bolt 212 secures the end cap 194 of the union 190 to a plug (not shown) that is rigidly fitted inside the transverse member 14 proximate the end 16 thereof. A dowel (not shown) is fixedly positioned transversely in both the end cap 194 and the plug (not shown) so as to inhibit rotation of the end cap 194 relative to the end 16 of the transverse member 14. Alternately, splines (or other suitable joining members) may be employed in the end cap 194 and the plug (not shown), to inhibit rotation therebetween. The base 94 of the rail 84 is pivotally secured in the union 190 such that the foot support assembly 80 is pivotable about the pin 208 from a collapsed position, in which the rail 84 is substantially parallel with the transverse member 14 of the frame structure 12 (see FIG. 1), to a fully extended position, in which the rail 84 rotates outwardly from the transverse member 14 and may abut the stop plate 206 of the union 190 to limit such rotation (see FIG. 4).

The union 192 is basically identical, in construction and operation, to the union 190. In such circumstances, the construction and operation of the union 92 will be discussed briefly hereinafter without describing the details thereof.

Referring now to FIGS. 6 and 8, like the union 190, the union 192 has a disc-shaped end cap 214 with a collar 216 fastened thereto. The collar 216 has a horizontal upper hinge plate 218 with a circular orifice 220 positioned therein, a horizontal lower hinge plate 222 with a circular orifice 224 positioned therein, and a vertical stop plate 226 extending vertically between the upper and lower plates 218, 222. The diameter of the vertical channel 150 of the base 148 of the rail 138 is substantially the same as the diameter of the orifice 220 of the upper hinge plate 218 of the union 192. The base 148 is pivotally secured to the collar 216, between the upper and lower plates 218, 222. A pin 228 extends through the orifice 220 of the upper hinge plate 218 and the channel 150 of the base 148, and is fastened to a circular disc 230 that is fixedly attached to the lower plate 222.

Figure 4:
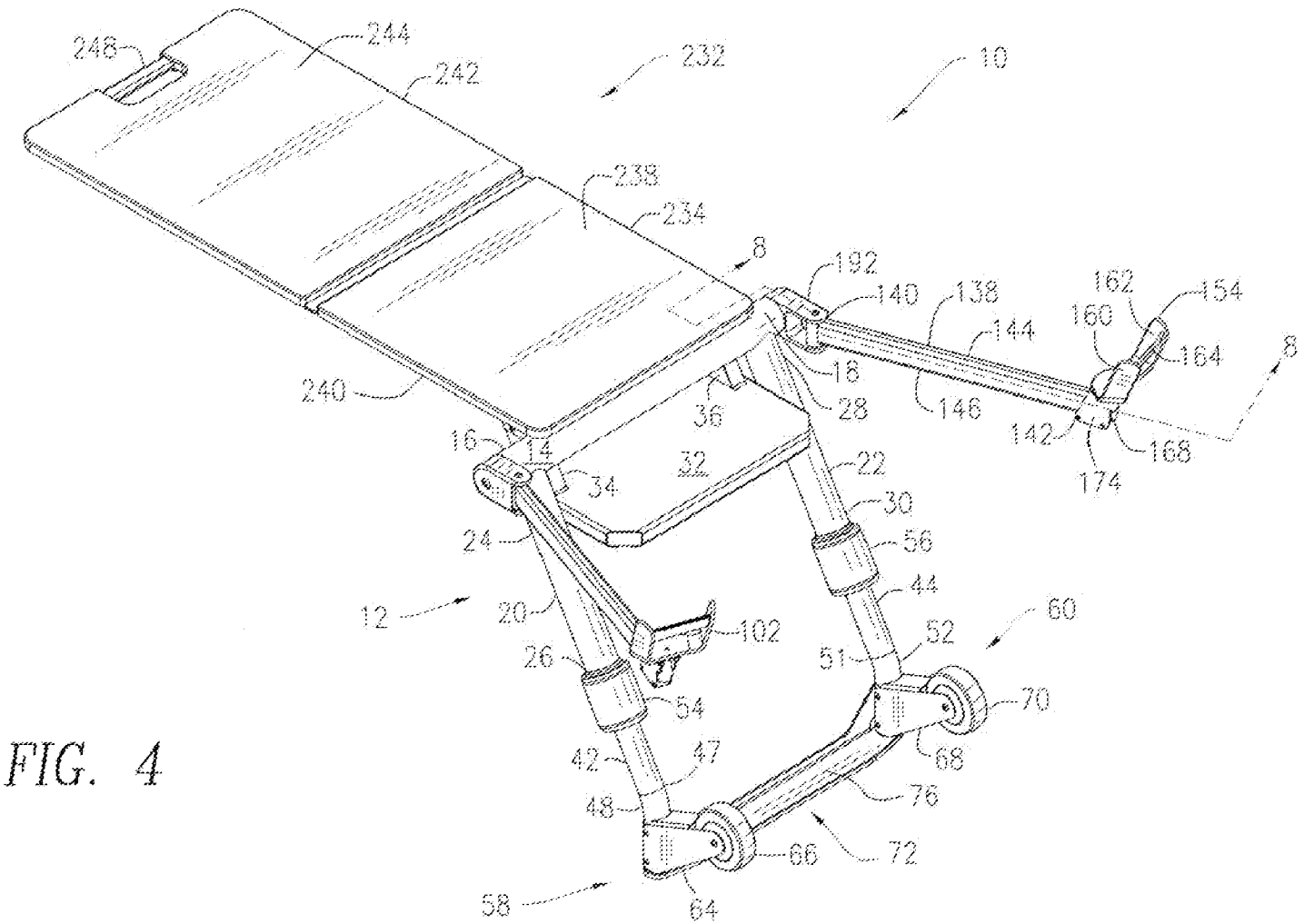
FIG. 4 is a perspective view similar to FIG. 1, except that the foot support assemblies and the patient support pads are shown in their extended positions.

Referring now to FIGS. 4-6, a support mat 232 is pivotally attached to the frame structure 12. More particularly, the mat 232 has a first panel 234 that is fabricated with a rigid planar core 236 (see FIG. 8) overlaid with padded upper and lower surfaces 238, 240, respectively, and a second panel 242 that is fabricated with a rigid planar core (not shown) overlaid with padded upper and lower surfaces 244, 246, respectively. The second panel 242 has a hand-hold 248 formed therein for purposes to be discussed hereinbelow. Hinge components 250, 252 (see FIG. 6) positioned on the lower surface 240 of the first panel 234 are pivotally connected to the hinge points 38, 40 of the brackets 34, 36, respectively. The second panel 242 is pivotally interconnected to the first panel 234 by a hinge 254 (see FIG. 5). The support mat 232 is pivotal between an extended position, in which it extends in a substantially horizontal direction from the transverse member 14 of the device 10 (see FIGS. 4 and 5), and a folded position, in which the first and second panels 234, 242 are folded so that the upper surfaces 238, 244, respectively, are positioned contiguously to each other in a substantially vertical orientation (see FIGS. 1-3). The support mat 232 is sized and shaped so as to support a patient on the upper surfaces 238, 244 of the first and second panels 234, 242 in a manner which is discussed in greater detail hereinbelow.

With reference to FIGS. 6 and 8, the mat 232 may be provided with a latching mechanism 256 for locking the first panel 234 in its extended position. More particularly, the latching mechanism 256 includes pivotal latches 258, 260 that releasably receive pins 262, 264, respectively, that are fitted to hinge components 250, 252, respectively. A latch release rod 266 is fixedly attached to the latches 258, 260, and is adapted to be hand operated for pivotally releasing the pins 262, 264 from the latches 258, 260, respectively, thereby unlocking (i.e., releasing) the first panel 234 so that it can be moved from its extended position. A strap (not shown) having one end fixedly attached to the middle area of the lower surface 246 of the second panel 242 may be stretched around the side members 20, 22 of the device 10 and releasably attached to the middle area of the lower surface 246 of the second panel 242 so as to secure the mat 232 in its folded position (i.e., the mat 232 is folded with the upper surfaces 238, 244 of the first and second panels 234, 242, respectively, positioned contiguously to each other in a substantially vertical orientation). Other means (e.g., clips, clasps) may be employed to secure the mat 232 in its folded position. In a similar fashion, a strap (not shown) may be used to secure the foot support assemblies 80, 82 to the transverse member 14.

Figure 10:
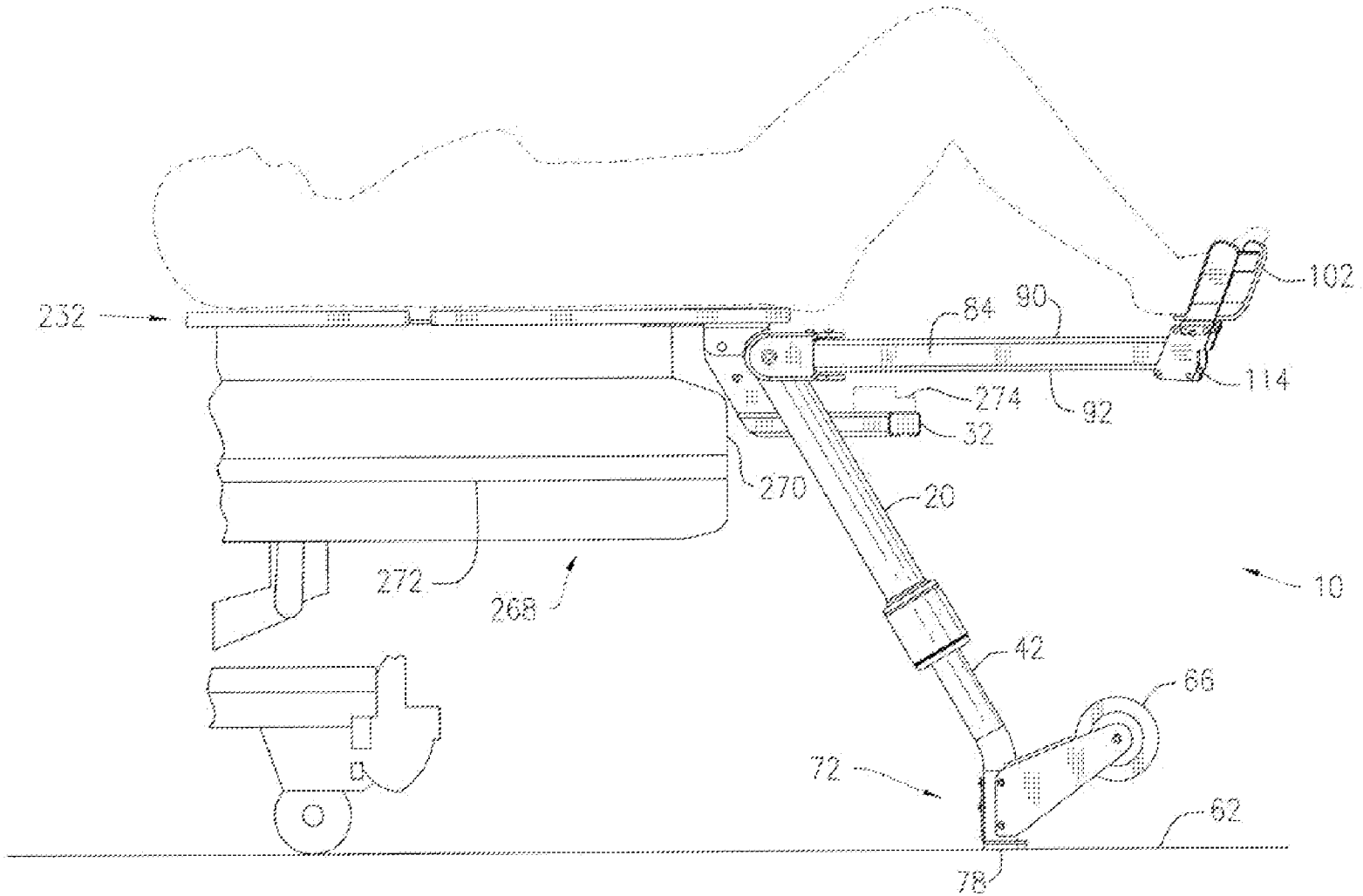
FIG. 10 is a side elevational view of the medical examination device shown in the foregoing figures, illustrating its use during a medical examination.

Referring to FIG. 10, in use during a medical examination (e.g., an obstetric/gynecological examination) performed on a patient lying in a hospital bed 268 having a removable foot board (not shown) at an end 270 thereof, the foot board (not shown) is first removed from the bed 268. The device 10 is then positioned against the end 270 of the bed 268. Alternatively, the device 10 could be placed against a side 272 of the bed 268. With the legs 42, 44 of the device 10 in their unlocked condition, the supporting mat 232 is extended and placed on the bed 268 with the transverse member 14 positioned against the end 270 of the bed 268. With the mat 232 laying substantially flat on the bed 268 and the pad 78 of the cross member 72 positioned flush on the floor 62, the legs 42, 44 are locked by operation of the locking collars 54, 56 in order to maintain the transverse member 14 at a constant height above the floor 62. The foot support assemblies 80, 82 are then fully extended, and the foot engaging units 100, 152 are positioned on the rails 84, 138, respectively, such that the stirrups 102, 154 are in position to accept the feet of a patient (shown in phantom in FIG. 10). The patient then places herself on the support mat 232 with her feet supported on the stirrups 102, 154. While seated, a medical practitioner (not shown) performs a medical examination (e.g., an obstetric/gynecological examination) on the patient. During the examination, the medical practitioner may conveniently place medical instruments 274 (shown in phantom) on the shelf 32 of the device 10.

After using the device 10, the support assemblies 80, 82 are pivoted to their collapsed positions (i.e., such that they are substantially parallel with the transverse member 14), and secured in such position as described above. Likewise, the mat 232 is unlocked, pivoted to its collapsed position (i.e., such that the upper surfaces 238, 244 are positioned contiguously to each other in a substantially vertical orientation) and then secured in such position as described above (see FIGS. 2-3).

Figure 11:
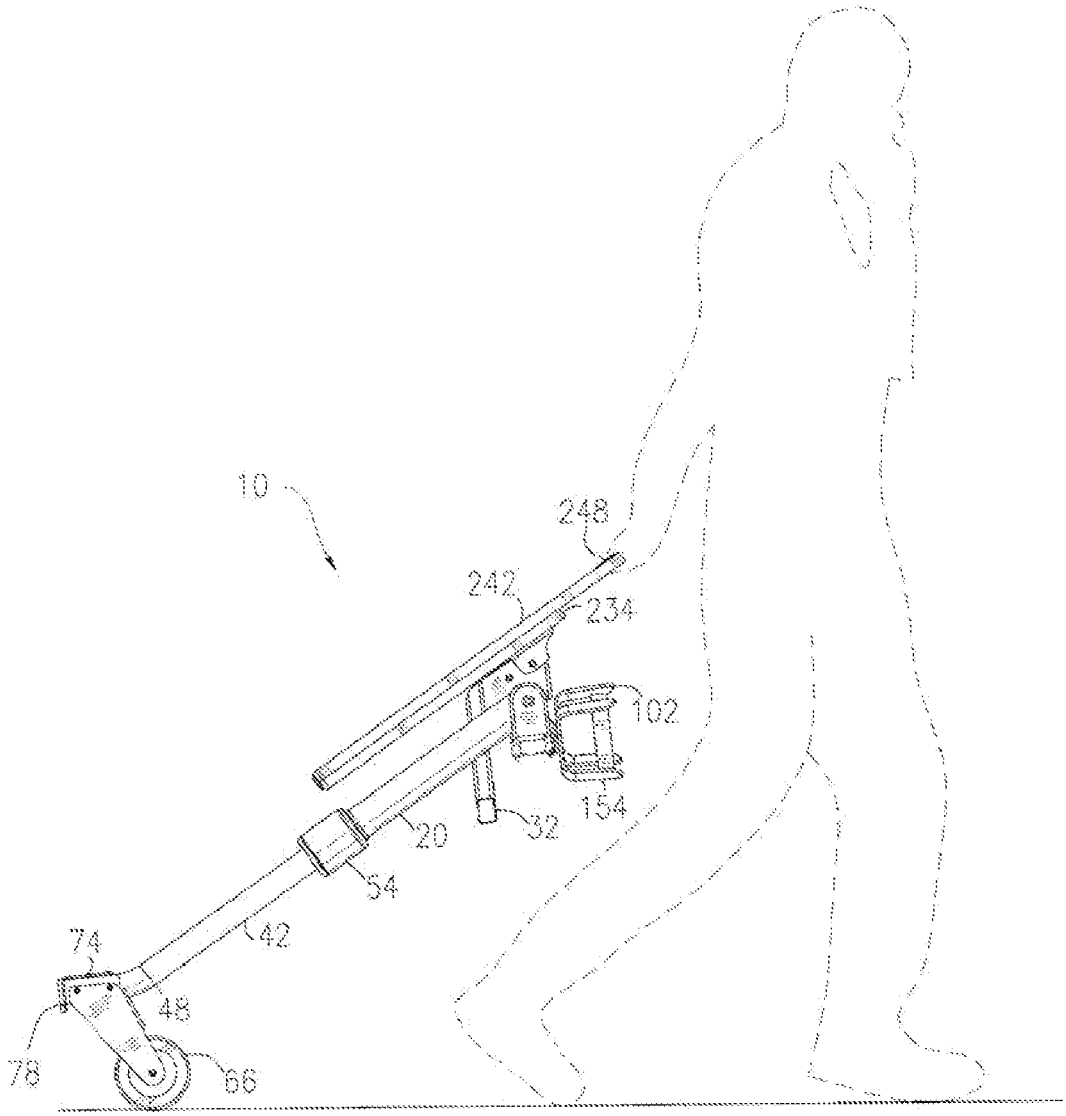
FIG. 11 is a side elevational view of the medical examination device shown in the foregoing figures, illustrating it being transported.

Referring to FIG. 11, a person (shown in phantom) who is transporting the device 10 from one location to another would grasp the hand hold 248 with one hand and pivot the device 10 onto the wheels 66, 70. The individual would then walk with the device 10 in tow behind his/her body, thereby maintaining one hand free of the device 10.

In storing the device 10, with reference to FIG. 3, the legs 42, 44 of the device 10 may be fully collapsed (i.e., such that they are inserted fully into the side members 20, 22) to achieve the maximum collapsed compact configuration of the device 10. In addition, with the device 10 positioned on the floor 62 with the weight of the device 10 being supported by the wheels 66, 70 and the cross member 72, the device 10 remains in an upright position.

It should be appreciated that the present invention provides numerous advantages over the prior art discussed above. For instance, because the device 10 is transportable, medical examinations, such as obstetric and/or gynecological examinations, can be performed alongside patient beds (e.g., hospital beds). As a result, the device 10 is particularly suitable for performing medical examinations on bed-bound patients. The device 10 is easily and rapidly deployed at the patient's bed 264 by pivotally extending the foot support assemblies 80, 82 and the support mat 232 from their folded positions. The position of the stirrups 102, 154 are easily adjustable along the rails 84, 138 respectively, of the device 10. The foot engaging units 100, 152 automatically prevent the patient's feet, when placed in the stirrups 102, 138, from sliding away from the patient along the rails 84, 138, respectively. In its collapsed position, the device 10 is easily transported by grasping the hand-hold 248 with one hand and rolling the device on the wheels 66, 70. The device 10 collapses into a compact small size, which facilitates transporting, shipping, maneuvering, and storing the device 10. During storage in the collapsed condition, the device 10 may be positioned in an upright position so as to occupy minimal storage space.

It should be noted that the present invention can have numerous modifications, variations and applications. For instance, the support mat 232 can be provided with alternate mechanisms such as panels that slide, in relation to each other, rather than fold. The rail follower assemblies 114, 166 may be provided with alternate means, such as manually operated friction grips, for locking their positions on the rails 84,138, respectively. Moreover, the device 10 can be used in conjunction with different types of medical devices (e.g., patient examination tables, etc.). The device 10 can also be used in facilitating the performance of many different types of medical examinations (e.g., gastroenterology examinations). Further, while the cross-sectional shape of the transverse member 14 and side members 20, 22 are generally round, it will be recognized that these members may be manufactured with other cross-sectional shapes, such as oval, rectangular or hexagonal, or may comprise other structural elements. It will also be recognized that the frame structure 12 of the device 10 may be formed in various other ways to provide a sturdy structure. Accordingly, all such variations and modifications, including those discussed above, are intended to be included within the scope of the invention as defined in the appended claims.

What is claimed is:

1. A device for facilitating a medical examination, comprising:

a frame structure having a transverse member with a first end and a second end opposite said first end, and first and second laterally-spaced side members attached to said transverse member, said first side member being attached to and extending from said first end of said transverse member, and said second side member being attached to and extending from said second end of said transverse member, said first and second side members being positioned substantially parallel to one another and substantially perpendicular to a longitudinal axis of said transverse member;

first and second legs attached to said frame structure, each of said first and second legs having a first end and a second end opposite thereof, said first end of said first leg being telescopically attached to said first side member, and said first end of said second leg being telescopically attached to said second side member such that each of said first and second legs is adjustably movable between a collapsed position, in which said first leg is received slidably within said first side member and said second leg is received slidably within said second side member, and an extended position, in which said first leg extends outwardly from said first side member and said second leg extends outwardly from said second side member;

a support mat pivotally attached to said transverse member of said frame structure, said support mat being pivotal between an extended position, in which said support mat extends in a substantially horizontal direction, and a folded position, in which said support mat extends substantially parallel to said first and second side members, said support mat being sized and shaped so as to support a patient thereon while said support mat is in its extended position during the performance of a medical examination; and first and second foot supports pivotally attached to said transverse member, said first foot support being attached to said first end of said transverse member, and said second foot support being attached to said second end of said transverse member, each of said first and second foot supports being sized and shaped so as to support one foot of a patient during the performance of a medical examination.

2. The device as claimed in claim 1, wherein each of said first and second foot supports is pivotable between a collapsed position, in which each of said first and second foot supports is substantially parallel with said transverse member, and an extended position, in which each of said first and second foot supports extends away from said transverse member.

3. The device of claim 2, wherein said first and second foot supports are movable laterally.

4. The device of claim 3, wherein said first foot support includes a first bracket and a first stirrup mounted to said first bracket; and wherein said second foot support includes a second bracket and a second stirrup mounted to said second bracket.

5. The device as claimed in claim 1, further comprising a shelf attached to said frame structure, said shelf being positioned substantially parallel to said support mat when said support mat is in its extended position.

6. The device as claimed in claim 5, further comprising a pair of brackets attached to said frame structure to facilitate pivotal attachment of said shelf to said frame structure.

7. The device as claimed in claim 1, further comprising a first wheel assembly attached to said second end of said first leg, and a second wheel assembly attached to said second end of said second leg, said first and second wheel assemblies facilitate the support and transportation of the device on a floor surface.

8. The device as claimed in claim 7, wherein said first wheel assembly includes a first bracket and a first wheel pivotally supported by said first bracket, and said second wheel assembly includes a second bracket and a second wheel pivotally supported by said second bracket, said first and second brackets being oriented such that an axel of said first wheel and an axel of said second wheel are each substantially parallel to said longitudinal axis of said transverse member.

9. The device as claimed in claim 8, further comprising a cross-member mounted between said first and second legs proximate to said second ends of said first and second legs, said cross-member being oriented substantially parallel to said longitudinal axis of said transverse member and adapted to engage the floor surface during the performance of the medical examination of the patient.

10. The device as claimed in claim 9, wherein said cross-member includes a flat plate having a bottom surface and a flat pad attached to said bottom surface, said flat pad being positioned flush with the floor surface so as to inhibit the device from moving on the floor surface during the performance of the medical examination of the patient.

11. The device as claimed in claim 10, further comprising a first locking collar for coupling said first side member with said first leg, and a second locking collar for coupling said second side member with said second leg, said first and second locking collars being adapted to guide and lock the movement of said first and second legs between their extended positions and their collapsed positions.

12. The device as claimed in claim 11, wherein the positions of said first and second legs are adjustable relative to said first and second members so as to position the height of said transverse member relative to the floor surface, said transverse member being adapted to abut an end of a bed and said support mat being adapted to be positioned on a top surface of the bed.

13. The device as claimed in claim 12, wherein said cross-member is attached fixedly to said first and second legs so that said first and second legs move between their collapsed and extended positions in substantially equal distances in relation to said first and second side members.

14. The device as claimed in claim 12, wherein said support mat includes a first panel, which is pivotally attached to said transverse member, and a second panel which is pivotally attached to said first panel.

15. The device as claimed in claim 14, wherein said first panel includes a rigid planar core overlaid with padded upper and lower surfaces, and said second panel includes a rigid planar core overlaid with padded upper and lower surfaces.

16. The device as claimed in claim 15, wherein said upper surface of said first panel and said upper surface of said second panel are positioned contiguously to each other when said support mat is in its said folded position.

17. The device as claimed in claim 16, wherein said support mat includes a latching mechanism for locking said first panel in its extended position and for releasing said first panel to enable said support mat to be moved from its extended position to its folded position.

18. The device as claimed in claim 17, wherein said second panel includes a handle that is sized and shaped for grasping by a user and to enable said device to be pivoted onto said first and second wheels for transporting said device from one location to another.

19. The device as claimed in claim 10, wherein said first and second wheel assemblies and said cross-member are adapted to engage the floor surface and support the weight of the device in order to maintain said device in an upright stored position.

20. A device for facilitating a medical examination, comprising:

a frame structure having a transverse member with a first end and a second end opposite said first end, and first and second laterally-spaced side members attached to said transverse member, said first side member being attached to and extending from said first end of said transverse member, and said second side member being attached to and extending from said second end of said transverse member, said first and second side members being positioned substantially parallel to one another and substantially perpendicular to a longitudinal axis of said transverse member;

first and second legs attached to said frame structure, each of said first and second legs having a first end and a second end opposite thereof, said first end of said first leg being telescopically attached to said first side member, and said first end of said second leg being telescopically attached to said second side member such that each of said first and second legs is adjustably movable between a collapsed position, in which said first leg is received slidably within said first side member and said second leg is received slidably within said second side member, and an extended position, in which said first leg extends outwardly from said first side member and said second leg extends outwardly from said second side member;

a first locking collar for coupling said first side member with said first leg, and a second locking collar for coupling said second side member with said second leg, said first and second locking collars being adapted to guide and lock the movement of said first and second legs between their extended positions and their collapsed positions;

a support mat pivotally attached to said transverse member of said frame structure, said support mat being pivotal between an extended, position, in which said support mat extends in a substantially horizontal direction, and a folded position, in which said support mat extends substantially parallel to said first and second side members, said support mat being sized and shaped so as to support a patient thereon while said support mat is in its extended position during the performance of a medical examination;

a cross-member mounted between said first and second legs proximate to said second ends of said first and second legs, said cross-member being oriented substantially parallel to said longitudinal axis of said transverse member and adapted to engage a floor surface during the performance of the medical examination of the patient so as to inhibit movement of the device relative to the floor surface;

first and second foot supports pivotally attached to said transverse member, said first foot support being attached to said first end of said transverse member, and said second foot support being attached to said second end of said transverse member, each of said first and second foot supports being sized and shaped so as to support one foot of a patient during the performance of a medical examination; and a first wheel assembly attached to said second end of said first leg, and a second wheel assembly attached to said second end of said second leg, said first and second wheel assemblies facilitate the support and transportation of the device on a floor surface.

* * * * *